US006782649B1

(12) United States Patent
Adler

(10) Patent No.: US 6,782,649 B1
(45) Date of Patent: Aug. 31, 2004

(54) REVERSIBLE PICTURE FRAME ASSEMBLY

(76) Inventor: Richard D. Adler, 500 S. Manlius St., Fayetteville, NY (US) 13066

( * ) Notice: Subject to any disclaimer, the term of this patent is extended or adjusted under 35 U.S.C. 154(b) by 63 days.

(21) Appl. No.: 10/266,949

(22) Filed: Oct. 9, 2002

(51) Int. Cl.[7] ..... A47G 1/06
(52) U.S. Cl. ..... 40/734; 40/747; 211/169
(58) Field of Search ..... 40/492, 606.15, 40/734, 747, 757; 248/447, 447.1, 458, 479, 480, 282.1, 285.1, 289.11; 211/169, 169.1

(56) References Cited

U.S. PATENT DOCUMENTS 447,815 A * 3/1891 Frercks ..... 40/497
1,110,973 A * 9/1914 Tischler ..... 248/486
1,365,107 A * 1/1921 Kehres ..... 40/500
1,448,664 A * 3/1923 Hull ..... 40/493
1,744,647 A * 1/1930 Lamar ..... 40/493
3,391,796 A * 7/1968 Cross ..... 211/169
4,253,738 A * 3/1981 Linkous ..... 359/855
4,451,021 A * 5/1984 Merriss ..... 248/480
4,866,723 A * 9/1989 Van Dongen ..... 372/46
6,112,445 A * 9/2000 Feeney ..... 40/747
6,260,296 B1 * 7/2001 Carney, Jr. ..... 40/747

* cited by examiner

*Primary Examiner*—Andrew Wright

(57) ABSTRACT

A reversible picture frame assembly for allowing the display of two pictures from a single picture frame. The reversible picture frame assembly includes a frame support assembly being adapted to be mounted to a wall structure and having an elongate main member, and also having an upper bracket member extending outwardly from the elongate main member, and further having a lower bracket member extending outwardly from the elongate main member and being spacedly disposed below the upper bracket member; and also includes a frame member having elongate top, bottom and side members and being movably mounted to the frame support assembly; and further includes transparent covers being mounted to the frame member for covering pictures being supported by the frame member.

5 Claims, 4 Drawing Sheets

REVERSIBLE PICTURE FRAME ASSEMBLY

BACKGROUND OF THE INVENTION

1. Field of the Invention

The present invention relates to reversible picture frames and more particularly pertains to a new reversible picture frame assembly for allowing the display of two pictures from a single picture frame.

2. Description of the Prior Art

The use of reversible picture frames is known in the prior art. More specifically, reversible picture frames heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,630,386; U.S. Pat. No. 4,939,860; U.S. Pat. No. 3,782,014; U.S. Pat. No. 4,991,332; U.S. Pat. No. 4,241,529; and U.S. Pat. No. Des. 329,333.

While these devices fulfill their respective, particular objectives and requirements, the aforementioned patents do not disclose a new reversible picture frame assembly. The prior art includes picture frames that can be removed and turned around upon support brackets.

SUMMARY OF THE INVENTION

The general purpose of the present invention, which will be described subsequently in greater detail, is to provide a new reversible picture frame assembly which has many of the advantages of the reversible picture frames mentioned heretofore and many novel features that result in a new reversible picture frame assembly which is not anticipated, rendered obvious, suggested, or even implied by any of the prior art reversible picture frames, either alone or in any combination thereof. The present invention includes a frame support assembly being adapted to be mounted to a wall structure and having an elongate main member, and also having an upper bracket member extending outwardly from the elongate main member, and further having a lower bracket member extending outwardly from the elongate main member and being spacedly disposed below the upper bracket member; and also includes a frame member having elongate top, bottom and side members and being movably mounted to the frame support assembly; and further includes transparent covers being mounted to the frame member for covering pictures being supported by the frame member. None of the prior art includes the combination of elements of the present invention.

There has thus been outlined, rather broadly, the more important features of the reversible picture frame assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new reversible picture frame assembly which has many of the advantages of the reversible picture frames mentioned heretofore and many novel features that result in a new reversible picture frame assembly which is not anticipated, rendered obvious, suggested, or even implied by any of the prior art reversible picture frames, either alone or in any combination thereof.

Still another object of the present invention is to provide a new reversible picture frame assembly for allowing the display of two pictures from a single picture frame.

Still yet another object of the present invention is to provide a new reversible picture frame assembly that is easy and convenient to set up and use.

Even still another object of the present invention is to provide a new reversible picture frame assembly that would save space for the user and would allow the user to easily change the décor without having to remove old pictures and hang new pictures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
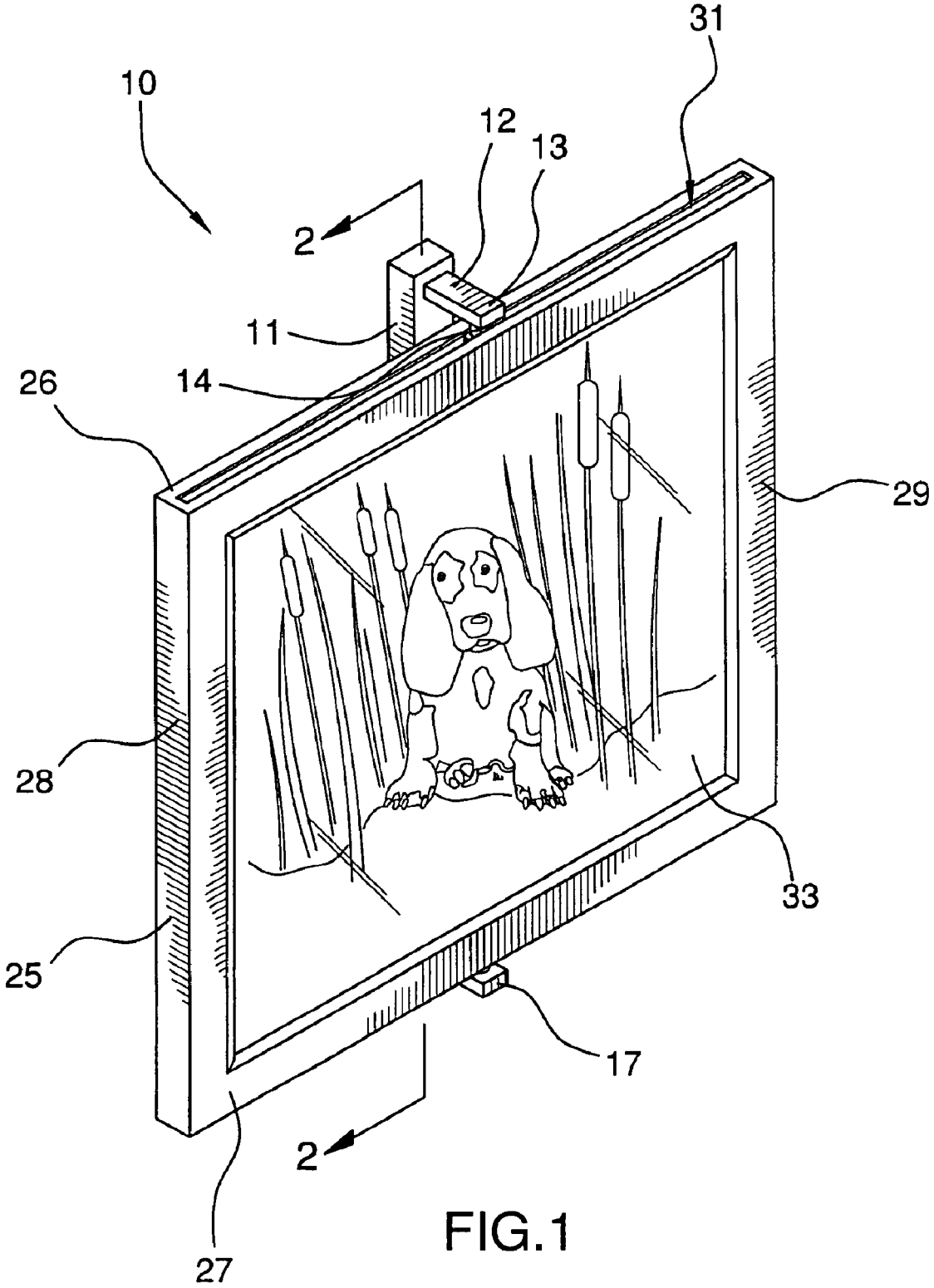
FIG. 1 is a perspective view of a new reversible picture frame assembly according to the present invention.
Figure 2:
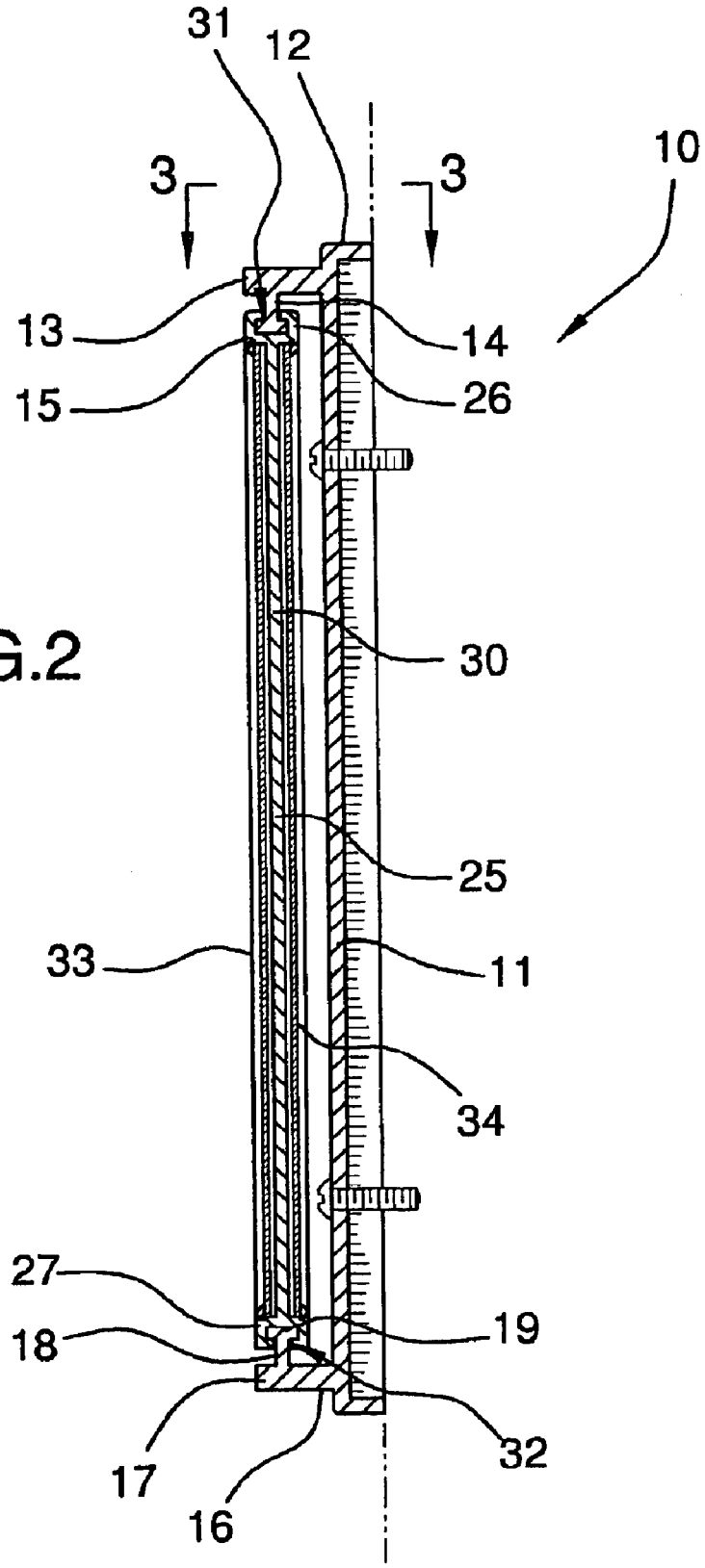
FIG. 2 is a cross-sectional view of the present invention.
Figure 3:
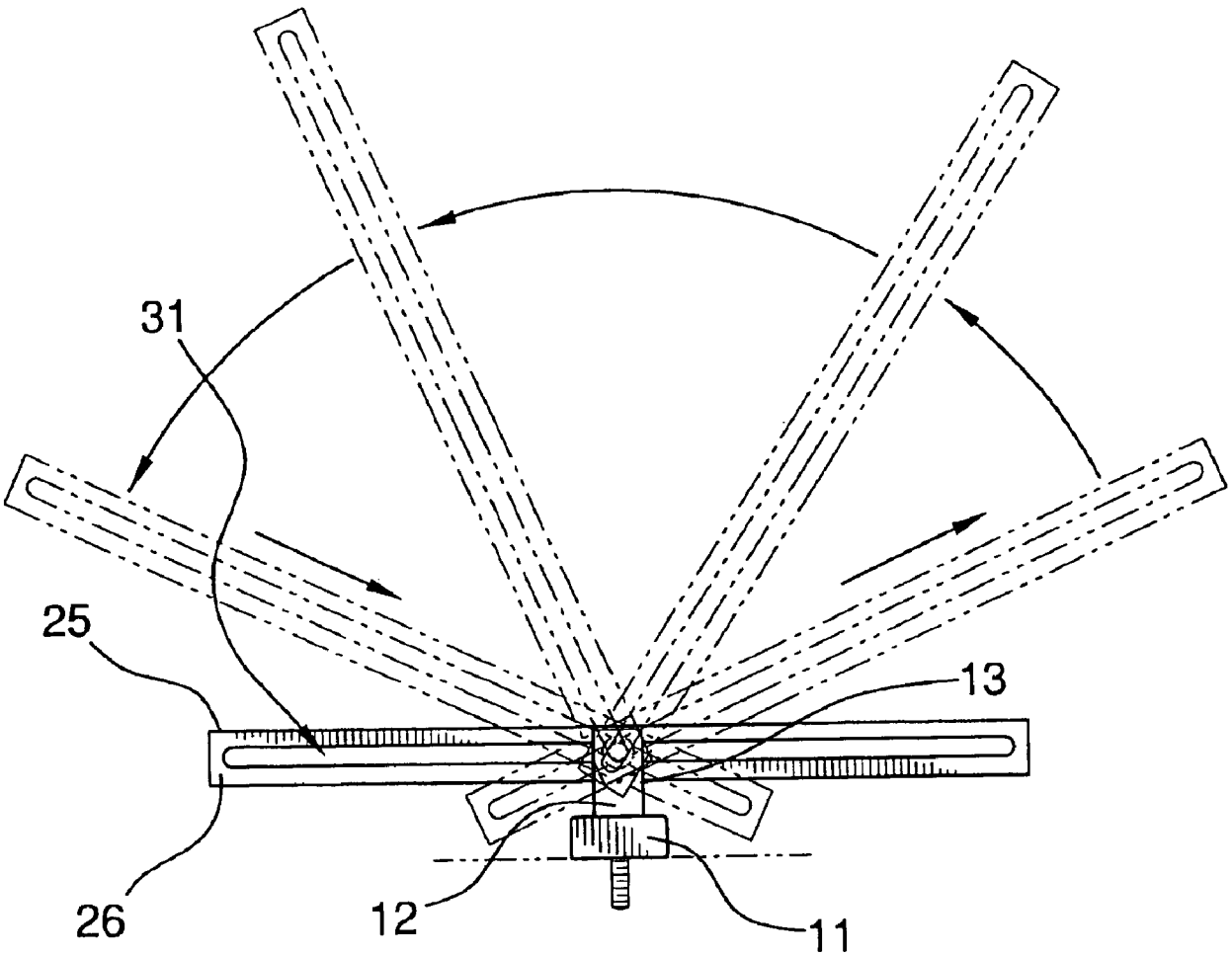
FIG. 3 is a top plan view of the present invention.
Figure 4:
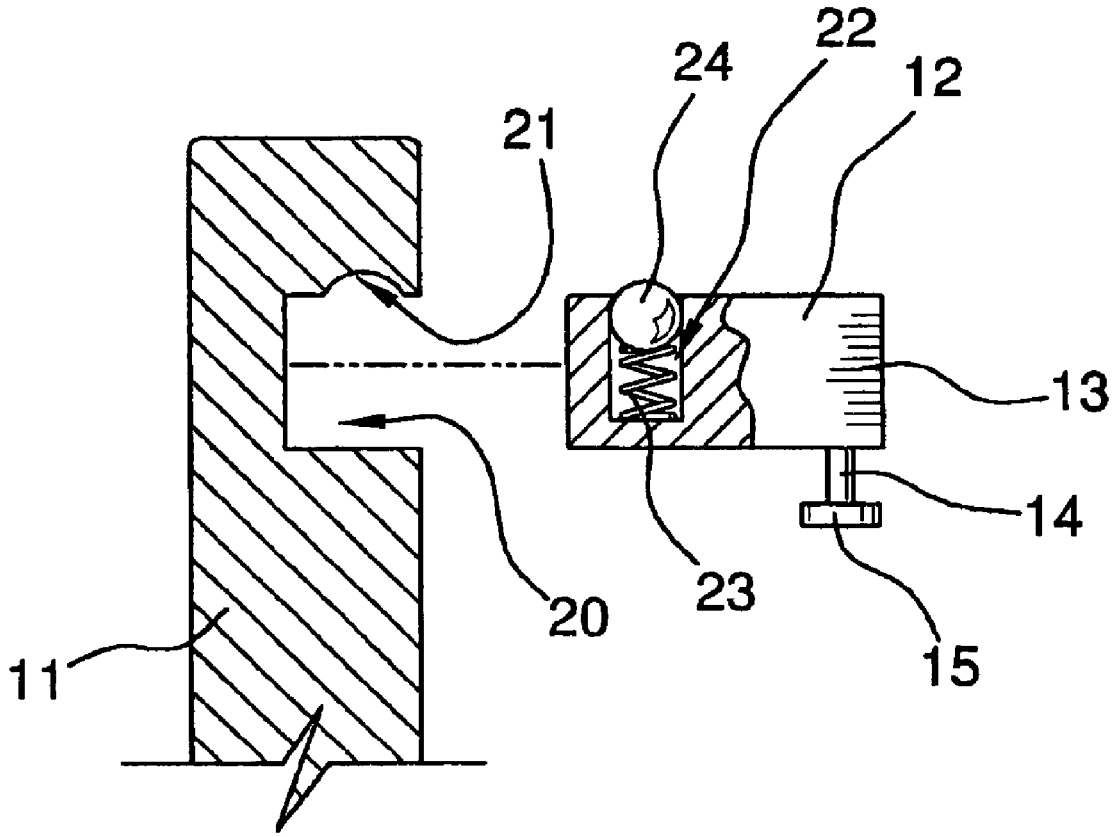
FIG. 4 is a detailed partial cross-sectional view of the elongate main member and one of the upper or lower bracket members of a second embodiment of the present invention.

With reference now to the drawings, and in particular to FIGS. 1 through 4 thereof, a new reversible picture frame assembly embodying the principles and concepts of the present invention and generally designated by the reference numeral 10 will be described.

As best illustrated in FIGS. 1 through 4, the reversible picture frame assembly 10 generally comprises a frame support assembly being adapted to be conventionally mounted with fasteners to a wall structure and having an elongate main member 11, and also having an upper bracket member 12, and further having a lower bracket member 16 and being spacedly disposed below the upper bracket member 12. The upper bracket member 12 includes a first finger-like extension member 13 being conventionally disposed near a top end of the elongate main member 11 and extending perpendicularly from the elongate main member 11, and also includes a first frame-retaining member 14,15 conventionally extending downwardly from near an end of the first finger-like extension member 13. The first frame-retaining member 14,15 includes a first stub shaft 14 being disposed generally perpendicular to the first finger-like extension member 13, and also includes a first disc-shaped member 15 being conventionally disposed at an end of the first stub shaft 14. The lower bracket member 16 includes a second finger-like extension member 17 being conventionally disposed near a bottom end of the elongate main member 11 and extending perpendicularly from the elongate main member 11, and also includes a second frame-retaining member 18,19 extending upwardly from near an end of the second finger-like extension member 16. The second frame-retaining member 18,19 includes a second stub shaft 18 being conventionally disposed generally perpendicular to the second finger-like extension member 17, and also includes a second disc-shaped member 19 being conventionally disposed at an end of the second stub shaft 18. As a second embodiment, the elongate main member 11 has slots 20 being disposed therein near the top and bottom ends thereof with each slot 20 having a notch 21 being disposed in a wall forming the slot 20. Each of the upper and lower bracket members 12,16 has a slot 22 being disposed in a side of a respective first and second finger-like extension member 13,17, and also has a spring 23 being securely disposed in the slot 22, and further has a ball-shaped detent 24 being disposed in the slot 22 and being engaged by the spring 23 and being removably biased in a respective notch 21 of the elongate main member 11 for securing a respective upper and lower bracket member 12,16 to the elongate main member 11.

A frame member 25 has elongate top, bottom and side members 26–29 and being movably and pivotally mounted to the frame support assembly. The frame member 25 also includes elongate tracks 31,32 being disposed in outer sides of and extending along lengths of the elongate top and bottom members 26,27, and further includes a partition 30 being centrally and conventionally attached to inner sides of the elongate top, bottom and side members 26–29 and being adapted to support pictures on either side thereof. The first and second disc-shaped members 15,19 are movably retained in the elongate tracks 31,32 to allow the frame member 25 to be pivoted upon the frame support assembly. The elongate track 31 in the elongate top member 26 has an inverted T-shaped lateral cross-section as viewed along one of the elongate side members 28,29, and the elongate track 32 in the elongate bottom member 27 has a T-shaped lateral cross-section as viewed along one of the elongate side members 28,29.

Transparent covers 33,34 are conventionally mounted to the frame member 25 for covering pictures being supported by the frame member 25. The transparent covers 33,34 are removably and securely supported by the frame member 25 and are disposed to opposite sides of the partition 30.

In use, the user places one picture on one side of the partition 30 and places another picture on the other side of the partition 30, and pivots and positions the fame member 25 so that at least one of the pictures is exposed for viewing. The user can change which of the two pictures is to be exposed for viewing by simply pivoting the frame member 25 about the upper and lower bracket members 12,16 so that the desired pictures is exposed for viewing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the reversible picture frame assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reversible picture frame assembly comprising:

a frame support assembly being adapted to be mounted to a wall structure and having an elongate main member, and also having an upper bracket member, and further having a lower bracket member being spacedly disposed below said upper bracket member, said upper bracket member including a first finger-like extension member being disposed near a top end of said elongate main member and extending perpendicularly from said elongate main member, and also including a first frame-retaining member extending downwardly from near an end of said first finger-like extension member, said first frame-retaining member including a first stub shaft being disposed generally perpendicular to said first finger-like extension member, and also including a first disc-shaped member being disposed at an end of said first stub shaft, said lower bracket member including a second finger-like extension member being disposed near a bottom end of said elongate main member and extending perpendicularly from said elongate main member, and also including a second frame-retaining member extending upwardly from near an end of said second finger-like extension member, said second frame-retaining member including a second stub shaft being disposed generally perpendicular to said second finger-like extension member, and also including a second disc-shaped member being disposed at an end of said second stub shaft, said elongate main member having slots being disposed therein near said top and bottom ends thereof with each said slot having a notch being disposed in a wall forming said slots;

a frame member having elongate top, bottom and side members and being movably mounted to said frame support assembly; and transparent covers being mounted to said frame member for covering pictures being supported by said frame member.

2. A reversible picture frame assembly as described in claim 1, wherein each of said upper and lower bracket members has a slot being disposed in a side of a respective said first and second finger-like extension member, and also has a spring being securely disposed in said slot, and further has a ball-shaped detent being disposed in said slot upon said spring and being removably biased in a respective said notch of said elongate main member for securing a respective said upper and lower bracket member to said elongate main member.

3. A reversible picture frame assembly comprising:

a frame support assembly being adapted to be mounted to a wall structure and having an elongate main member, and also having an upper bracket member, and further having a lower bracket member being spacedly disposed below said upper bracket member, said upper bracket member including a first finger-like extension member being disposed near a top end of said elongate main member and extending perpendicularly from said elongate main member, and also including a first frame-retaining member extending downwardly from near an end of said first finger-like extension member, said first frame-retaining member including a first stub shaft being disposed generally perpendicular to said first finger-like extension member, and also including a first disc-shaped member being disposed at an end of said first stub shaft, said lower bracket member including a second finger-like extension member being disposed near a bottom end of said elongate main member and extending perpendicularly from said elongate main member, and also including a second frame-retaining member extending upwardly from near an end of said second finger-like extension member, said second frame-retaining member including a second stub shaft being disposed generally perpendicular to said second finger-like extension member, and also including a second disc-shaped member being disposed at an end of said second stub shaft;

a frame member having elongate top, bottom and side members and being movably mounted to said frame support assembly, said frame member also including elongate tracks being disposed in outer sides of and extending along lengths of said elongate top and bottom members, and further including a partition being centrally attached to inner sides of said elongate top, bottom and side members and being adapted to support pictures on either side thereof, said first and second disc-shaped members being movably retained in said elongate tracks to allow said frame member to be pivoted upon said frame support assembly; and transparent covers being mounted to said frame member for covering pictures being supported by said frame member.

4. A reversible picture frame assembly as described in claim 3, wherein said elongate track in said elongate top member has an inverted T-shaped lateral cross-section as viewed along one of said elongate side members, and said elongate track in said elongate bottom member has a T-shaped lateral cross-section as viewed along one of said elongate side members.

5. A reversible picture frame assembly as described in claim 4, wherein said transparent covers are removably and securely supported by said frame member and are disposed to opposite sides of said partition.

* * * * *